United States Patent [19]

Stanelle

[11] 4,338,752

[45] Jul. 13, 1982

[54] COLLAPSIBLE SILO

[76] Inventor: Karl-Heinz Stanelle, Rosenstr. 4, D-7129 Güglingen, Fed. Rep. of Germany

[21] Appl. No.: 108,174

[22] Filed: Dec. 28, 1979

[30] Foreign Application Priority Data

Jan. 2, 1979 [LU] Luxembourg ..... 80749
Dec. 7, 1979 [DE] Fed. Rep. of Germany ..... 2949313

[51] Int. Cl.[3] ..... E04H 7/00
[52] U.S. Cl. ..... 52/194; 52/245
[58] Field of Search ..... 52/197, 194, 192, 245, 52/246, 247

[56] References Cited

U.S. PATENT DOCUMENTS

| | | | |
|---|---|---|---|
| 897,709 | 9/1908 | Ball | 52/245 |
| 2,691,959 | 10/1954 | Dueringer | 52/194 |
| 3,270,480 | 9/1966 | Beecker | 52/726 |
| 4,112,634 | 9/1978 | Bissinger | 52/194 |
| 4,218,859 | 8/1980 | Sams | 52/194 |

FOREIGN PATENT DOCUMENTS

| | | | |
|---|---|---|---|
| 1066009 | 9/1959 | German Democratic Rep. | 52/194 |
| 555940 | 2/1957 | Italy | 52/194 |

*Primary Examiner*—Price C. Faw, Jr.
*Assistant Examiner*—Henry E. Raduazo
*Attorney, Agent, or Firm*—Kontler, Grimes & Battersby

[57] ABSTRACT

A storage silo includes a support structure and a disassemblable container mounted on the support structure with its longitudinal axis extending vertically. The container includes a plurality of neighboring sections which conically diverge in the downward direction and have upper and lower end portions which overlap one another in assembled condition of the container. The sections fit into one another in disassembled condition to form a transportation package; a discharge hopper of downwardly converging conical configuration is also accommodated, in inverted condition, in the transportation package, as is a protective railing which, in the assembled condition, is mounted on the top of the container. The lower end portions of the upper sections may fittingly surround, or may be fittingly received within, the upper end portions of the respective downwardly adjacent sections in the assembled condition, and these cooperating end portions are connected to one another by screws, bolts, or similar connectors.

5 Claims, 3 Drawing Figures

COLLAPSIBLE SILO

BACKGROUND OF THE INVENTION

The present invention relates to storage arrangements in general, and more particularly to a silo having a callapsible, particularly cylindrical, vertical container mounted on a support structure.

Silos of various constructions are already known and usually include a cylindrical container which is so mounted on a support structure that its longitudinal axis extends vertically. A silo of this type usually has a discharging portion or hopper of a downwardly conically converging configuration, which has a closable discharge opening at its lower end. Such silos have to accommodate grain or other particulate or pourable materials, so that they have to have substantial dimensions. For instance, the container may have a height of 5 to 7 meters and a diameter of several meters, such as $1\frac{1}{2}$ to 3 meters.

If such containers were to be transported to the location of use in assembled condition, they would take up a considerable amount of space during transport and/or require the use of special trucks or the like. To alleviate this problem, it has already been proposed to make the containers in a plurality of sections so that they could be transported to their destination in disassembled condition, and then assembled in situ. In this context, it has been proposed to select for the sections such dimensions that they can be at least partially introduced into one another and transported in this condition. However, all of the heretofore known constructions of this type were less than fully satisfactory, particularly because of their complexity and the multitude of steps which had to be carried out during the assembly of containers at the location of use. Moreover, the complexity of the mounting operations required the use of highly skilled labor for the erection of such silos.

OBJECTS AND SUMMARY OF THE INVENTION

It is an object of the present invention to provide a storage arrangement, particularly a silo, which does not exhibit the disadvantages of the prior-art storage arrangements.

Still another object of the present invention is to so construct the container of the storage arrangement as to be easily callapsible for transport to the location of use and easily assembled at such a location without requiring the use of any special tools and/or highly skilled personnel.

It is a further object of the present invention to so design the container as to have a substantially smooth contour at least at its inside so as not to interfere with the descent of material toward a bottom outlet opening.

A concomitant object of the present invention is to provide a storage arrangement, particularly a silo, which is simple in construction, easy and inexpensive to manufacture and install, and which provides room for reliable accommodation of the material to be stored therein.

One feature of the present invention resides in the provision of a storage arrangement, particularly a silo, comprising a plurality of discrete tubular sections (especially sections each of which has a substantially circular outline which in assembled condition together constitute an elongated container wherein the sections longitudinally (especially vertically) adjoin one another and respectively have longitudinally spaced first and second (upper and lower) end portions, wherein at least some of the sections diverge (especially conically) from the first (upper) toward the second (lower) end portions and are so dimensioned as to be receivable with play within one another in disassembled condition and that the first and second (upper and lower) end portions of longitudinally (vertically) adjacent or neighboring sections fittingly overlap each other in the assembled condition. The storage arrangement further comprises means for supporting the container (especially with the longitudinal axis of the container extending substantially or exactly vertically). The container which is constructed in the above-discussed manner exhibits several advantages. First of all, the sections can be transported to the location of use in the disassembled condition in which sections take up only as much loading area on the truck as the largest of the sections would assume alone. Secondly, the container can be readily erected or assembled at the location of use by fitting the sections into one another in the above-discussed manner and by thereupon connecting the sections to each other. Furthermore, at least the majority of sections are smooth at their end portions and do not require the provision of any flange thereat. This greatly facilitates and simplifies the manufacture of the sections.

In view of the aforedescribed construction of the interfitted sections of the container, the cross-section of the space bounded by the container increases in the downward direction, which facilitates the descent of granular or particulate material contained in this space toward the outlet or discharge opening provided at the bottom of the container. The steps or shoulders which develop in the regions where the adjacent container sections are connected to one another need not be thicker than the material from which the sections are made, such as sheet metal. Steps of such magnitude do not hinder the granular or particulate material in its descent, even in the event that they are so oriented that the end faces of these steps face counter to the direction of descent of the material.

An advantage of the above-discussed construction of the container is that its assembly is very simple in that it merely involves the connection of the fittingly overlapping end portions of the neighboring sections of the container. This task can be accomplished even by a person having only a minimum of experience or mechanical skill. Advantageously, the sections are connected to one another at their end portions by means of screws passing through prefabricated holes in the end portions.

It is very advantageous when, in accordance with each present invention, the lower end portion of the upper section fittingly surrounds the upper end portion of the downwardly adjacent section. This construction is advantageous in that the sections support one another due to the fitting engagement thereof, and in that the spaces between these end portions do not open upwardly at the exterior of the container, so that no water deposited at the exterior of the container due to rain or other precipitation can flow into the interior of the container.

In a further development of the present invention, the lower end portion of each upper section is fittingly received in the upper end portion of the downwardly adjacent section. This arrangement is advantageous in that the container sections can be telescopically pulled out from the transportation package of interfitted sections and the upper end portions of the container sections of the assembled container are located outwardly of the container sections thereabove so that no deposit of the particulate of granular material can occur on any ledges which would otherwise develop.

The novel features which are considered as characteristic of the invention are set forth in particular in the appended claims. The improved storage arrangement itself, however, both as to its construction and the mode of assembling the same, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
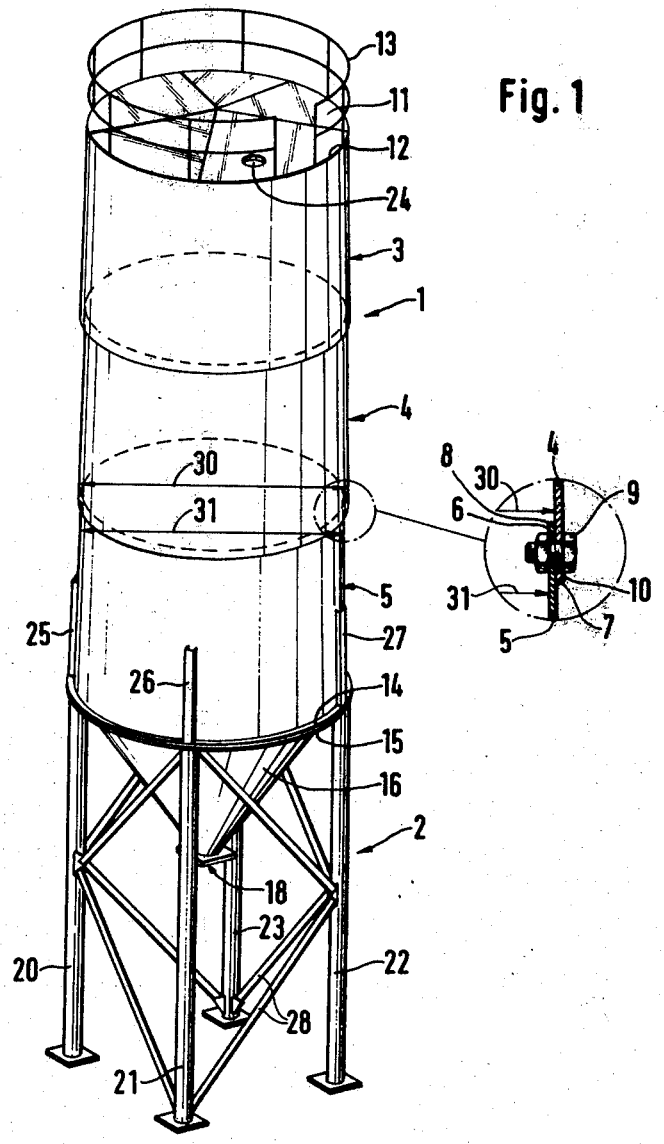
FIG. 1 is a perspective view of a storage arrangement which is constructed in accordance with a first embodiment of the present invention and is shown in assembled condition.
Figure 2:
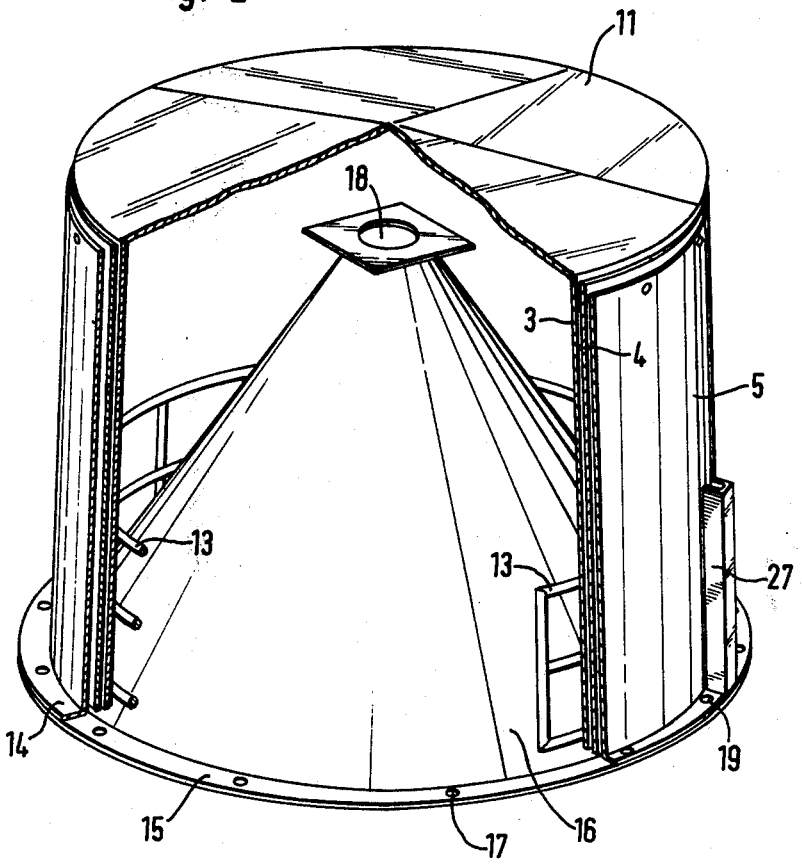
FIG. 2 is an enlarged perspective partly sectional view of a transportation package consisting of the sections of the container of FIG. 1 in disassembled condition and introduced into one another.

Referring first to FIG. 1, the reference character 1 denotes a container, and the reference numeral 2, a support structure for the container 1. The container 1 is shown in assembled condition and is mounted on the completed support structure 2 by means of connectors, such as screws. The container 1 consists of a plurality of, for instance three, container sections 3, 4 and 5 which conically diverge in the downward direction so that, when they are disassembled as shown in FIG. 2, they can be introduced with play into one another in such a manner that the upper container sections 3 and 4 are respectively introduced from below into the adjacent container sections 4 and 5 therebelow so that, in the condition shown in FIG. 2 in which the sections 3, 4 and 5 together form a transportation package, the uppermost container section 3 is surrounded by the next following container section 4 and the latter is, in turn, surrounded by the following lower container section, here the lowermost section 5.

In the assembled condition, the upper end portions of the lower sections 4 and 5 are fittingly received in the lower end portions of the respective upwardly adjacent container sections 3 and 4, and the end portions which fittingly surround one another in this manner are connected to one another along their peripheries by resorting to prefabricated bores. This is illustrated in the encircled enlarged detail view of FIG. 1 which shows how the lower end portion 7 of the container section 4 and the upper end portion 8 of the container section 5 engage one another at their respective inner and outer surfaces. The end portion 7 has a bore 10, while the end portion 8 has a registering bore 6, and a threaded bolt 9 meshing with a nut passes through the bores 10 and 6 from the exterior to the interior of the container 2. To facilitate the aligning of the bores 10 and 6, at least one of these bores may constitute an elongated slot, rather than having a circular cross section. In this manner, the two end portions 7 and 8 are connected to one another by means of threaded connectors, such as the bolts 9 which are distributed about the periphery of the section 4. The sections 3 and 4 are connected to one another in the same or in a similar manner. Of course, rivets could be used instead of bolts, especially where the container 2 is not to be disassembled once it has been erected at the desired location.

The uppermost container section 3 is formed with a lid 11 which extends across and thus closes the upper end portion of the section 3. A protective railing 13 in the form of a grid is mounted along the marginal portion of the lid 11 and is connected thereto by means of conventional connecting elements, such as screws. In the disassembled condition, the railing 13 constitutes an open ring which, as may be seen in FIG. 2, can be compressed and introduced from below into the container section 3 so as to be fittingly accommodated therein during transport of the container 1 to the location of use.

The lowermost container section 5 is equipped with an outwardly projecting flange 14, which is connected, for instance by screws, with a correspondingly configurated, outwardly projecting flange 15 of a downwardly converging substantially frustoconical discharge hopper 16. Such screws extend through holes 17 and 19 which are visible on the respective flanges 15 and 14 in FIG. 2. The frustoconical hopper 16 thus has a gradually downwardly diminishing cross section which reaches its minimum at a discharge opening 18 provided at the lower end of the hopper 16. The discharge opening 18 can be closed in any conventional manner, and a conveying arrangement, such as a conveyor screw or the like, can be attached thereto for the purpose of emptying the container 1.

The container 1 can be filled, or partially filled, with the granular or particulate material via an inlet opening 24 provided in the top wall or lid 11 of the uppermost section 3. The material can be delivered to the opening 24 by means of a pneumatic conduit or a similar feeding arrangement. The conduit is usually led along the periphery of the container 1 from the ground level to the top of the container 1. The conduit can be connected to the container 1 by means of non-illustrated conventional clamps or the like, and such connecting elements can be held on the container 1, for example, by the threaded bolts 9.

The flange 15 is so configurated as to be ready to be connected, for instance, by threaded connectors, to the support structure 2. As illustrated, the support structure 2 includes four vertically extending legs 20, 21, 22 and 23 which are interconnected by means of various bracing elements, such as bracing elements 28 indicated in the drawing. The legs 20, 21, 22 and 23 and the bracing elements 28 are connected to one another, for instance, by threaded connectors such as screws, and are assembled and connected with one another into the support structure 2 only at the construction site. This renders it possible to transport the elements 20, 21, 22, 23 and 28 of the support structure 2 to the construction site in the form of a bundle.

In order for the container 1 to be able to better withstand the forces acting thereon, reinforcing rails 25–27 are connected, for instance, welded, to the lowermost section 5 of the container 1 in such distribution around the periphery of the latter that these rails 25–27 respectively constitute extensions of the legs 20–23. This improves the transmission of forces between the section 5 and the support structure 2 and reduces the stresses which would otherwise be applied to the section 5 or the flanges 14 and 15.

As mentioned before, FIG. 2 shows the sections 3, 4 and 5 of the container 1 in disassembled condition in which they form a transportation package. As also illustrated, the discharge hopper 16 is introduced from below into the already formed transportation package constituted by the sections 3, 4 and 5 in an inverted orientation, so that the two flanges 14 and 15 are again juxtaposed. In this condition, the flanges 14 and 15 can be connected with one another by screws or the like which pass through the holes 17 and 19. Of course, such threaded connectors need not be fully tightened or tightened with any substantial force since this condition is only for transportation and, consequently, is transitory rather than permanent. However, is such threaded connectors are used, the transportation package 3, 4, 5, 13 and 16 will be held together while being stored or transported.

The container sections 3–5 have approximately the same length, as considered in the axial direction, while the discharge hopper 16 is somewhat shorter so that, in the condition illustrated in FIG. 2, the discharge opening 18 cannot touch the lid 11 of the section 3. It may be seen that a sufficient amount of space is available between the discharge hopper 16 and the innermost section 3 for the accommodation of the protective railing 13 in its compressed condition.

For storage and transportation purposes, the storage arrangement of the present invention consists of the assembly illustrated in FIG. 2, and a bundle of elements which, in their assembled condition, constitute the support structure 2. However, this bundle has not been illustrated, and neither have other small or auxiliary parts such as screws, nuts, lugs, clamps or the pneumatic conduit.

Referring again to the detail of FIG. 1, the inner diameter of the section 4 at the lower end portion 7, which is indicated by an arrow 30, is greater by twice the wall thickness plus tolerance than the inner diameter of the upper end portion 8 of the container section 5 as indicated by an arrow 31. The same applies for the dimensions of the other end portions which overlap one another in the assembled condition and are connected to one another by threaded connectors or the like.

As mentioned before, the container sections 3, 4 and 5 diverge, especially conically, in the downward direction. Thus, each of the container sections 3, 4 and 5 has a somewhat smaller diameter at its upper end portion than at its lower end portion. The result is that each of the sections 3 and 4 is somewhat smaller in diameter than the respective downwardly adjacent sections 4 and 5. These differences are such that the container sections 3, 4 and 5 can be inserted into one another to form the transportation package of FIG. 2, in which condition they are stored and/or transported.

Figure 3:
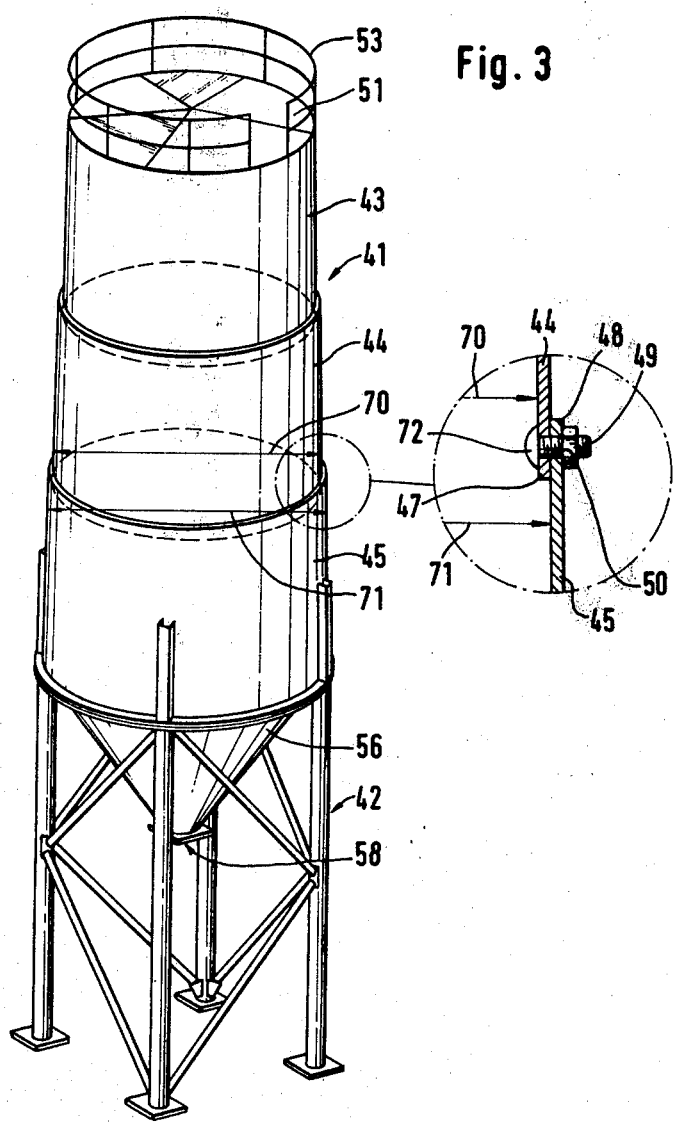
FIG. 3 is a view similar to that of FIG. 1 but showing a modified storage arrangement.

FIG. 3 illustrates a modification of the container 1 of FIG. 1, wherein the parts and elements have been denoted by reference numerals higher by 40 than the numerals denoting the corresponding parts and elements of FIG. 1. In contradistinction to the container 1 of FIG. 1, the container 41 of FIG. 3 is so configurated that the upper end portions of the sections 44 and 45 surround the lower end portions 47 of the sections 43 and 44, rather than being surrounded thereby as they are in the container 1 of FIG. 1. The inner diameter of the container section 44 at its lower end portion 47, as indicated by the arrow 70, is smaller by twice the wall thickness plus tolerance than the inner diameter, indicated by the arrow 71, of the upper end portion 48 of the container section 45. The same applies for the dimensions of the other end portions which, in the assembled condition of the container 41, overlap one another and are connected to each other by connecting elements, such as screws or the like.

The container sections 43, 44 and 45 are connected to one another by means of threaded bolts such as the bolts 49 shown in the enlarged detail view of FIG. 3. The bolts are distributed around the circumference of the respective sections 43, 44 and 45 and pass through prefabricated aligned bores or holes, such as, for example, the hole 50. The threaded connector 49 has a rounded head 72 which is received in the interior of the container 41. As a result of this, the material accommodated in the interior of the container 41 cannot become deposited on the head 72 and thus its downward progress is not obstructed by the latter. The other threaded connectors are configurated in the same or a similar manner.

As in the container 1, the sections 43, 44 and 45 taper, especially conically, in the upward direction so that, in the assembled condition, the end portions, such as 47 and 48, fittingly surround and frictionally engage one another. When it is desired to transport the container in disassembled condition, the connectors 49 are loosened and removed from the holes 50, whereupon the sections 43, 44 and 45 of the container 41 are telescopically collapsed into a transportation package corresponding to that illustrated in FIG. 2.

The remaining parts, such as the support structure 42, the lid 51, the frustoconical discharging hopper 56 having the discharge opening 58, and the protective railing 53 are constructed in the same way or similarly to the corresponding elements of the storage arrangement of FIG. 1.

Without further analysis, the foregoing will so fully reveal the gist of the present invention that others can, by applying current knowledge, readily adapt it for various applications without omitting features that, from the standpoint of prior art, fairly constitute the generic and specific aspects of my contribution to the art and, therefore, such adaptations should and are intended to be comprehended within the meaning and range of equivalence of the claims.

I claim:

1. A storage arrangement, particularly a silo, comprising a plurality of superimposed tubular sections having telescopically interfitted ends and including an uppermost and a lowermost section, said lowermost section being dimensioned to receive the remainder of said sections internally thereof for transport and having a lower end provided with an outwardly extending first flange; a hopper below said lowermost section having an upper end portion provided with an outwardly extending second flange disposed adjacent said first flange and supporting the same, said hopper being dimensioned so as to be receivable in the smallest of said sections substantially in its entirety with said flange abutting said first flange when said hopper is inverted and inserted into said sections for transport, and said flanges having alignable openings adapted to be connected with one another both in the upright and inverted positions of said hopper.

2. The storage arrangement of claim 1, further comprising means for connecting said interfitted ends to each other.

3. The storage arangement of claim 1, further comprising an arcuate railing provided on top of said uppermost section, said railing extending along an arc which is sufficiently small to allow for insertion of said railing into the interior of said lowermost section and around the inverted hopper subsequent to a reduction of the radius of curvature of said railing.

4. The storage arrangement of claim 1, wherein said sections have substantially identical axial lengths.

5. The storage arrangement of claim 1, further comprising means for securing said interfitted ends to one another, said securing means comprising a plurality of bolts extending substantially radially of said sections and having rounded heads in the interiors of said sections so that said heads cannot interfere with the descent of material, said hopper having an outlet opening for such material.

* * * * *

UNITED STATES PATENT AND TRADEMARK OFFICE

CERTIFICATE OF CORRECTION

PATENT NO. : 4,338,752

DATED : July 13, 1982

INVENTOR(S) : Karl-Heinz STANELLE

It is certified that error appears in the above-identified patent and that said Letters Patent are hereby corrected as shown below:

Col. 1, line 3, "callapsible" should read --collapsible--;
line 48, "callapsible" should read --collapsible--.
Col. 2, line 18, insert --the-- before "sections";
line 54, "each" should read --the--.
Col. 6, line 60, insert --second-- before "flange".

Signed and Sealed this

*Twenty-third* Day of *October 1984*

[SEAL]

*Attest:*

GERALD J. MOSSINGHOFF

*Attesting Officer*

*Commissioner of Patents and Trademarks*